United States Patent [19]

Orii et al.

[11] Patent Number: 4,841,206

[45] Date of Patent: Jun. 20, 1989

[54] SPEED CONTROL DEVICE FOR AN ELECTRONIC SEWING MACHINE

[75] Inventors: Akira Orii; Takeshi Kongo, both of Tokyo, Japan

[73] Assignee: Janome Sewing Machine Co., Ltd., Tokyo, Japan

[21] Appl. No.: 166,640

[22] Filed: Mar. 11, 1988

[30] Foreign Application Priority Data

Mar. 24, 1987 [JP] Japan ..... 62-67870

[51] Int. Cl.[4] ..... D05B 69/36

[52] U.S. Cl. ..... 388/828; 318/558; 112/1; 112/277

[58] Field of Search ..... 318/301, 333, 336, 558; 112/1, 275, 277, 300

[56] References Cited

U.S. PATENT DOCUMENTS 3,836,834 9/1974 Abbatiello et al. ..... 318/488 X
4,295,080 10/1981 Fujita et al. ..... 318/257

FOREIGN PATENT DOCUMENTS 2935585 3/1981 Fed. Rep. of Germany ..... 112/277
59-232580 12/1984 Japan ..... 112/277

*Primary Examiner*—Bentsu Ro
*Attorney, Agent, or Firm*—Michael J. Striker

[57] ABSTRACT

Variable potential and breaking detection potential of a controller in a sewing machine are respectively subjected to analog-to-digital conversions, thereby to make it possible that the breaking detection of the controller and correction of dispersions of component accuracies of the controller are effected at one time.

12 Claims, 3 Drawing Sheets

SPEED CONTROL DEVICE FOR AN ELECTRONIC SEWING MACHINE

FIELD OF THE INVENTION

The present invention relates to speed control of an electronic sewing machine to be controlled by a microcomputer.

BACKGROUND OF THE INVENTION

Heretofore, in a system employing a variable resistance type controller, wherein rotation number of a sewing machine is varied by changing potential of the controller, breaking of connectors has been detected in order to prevent malfunction due to the breaking of a signal line of the connectors (and defective contact of a connector) in the controller. Detection of the breaking, however, has been imperfect. Moreover it has sometimes been seen that the variable range of the controller narrows due to the dispersion of components such as variable resistor, or that the variable potential thereof fails to rise up to a set value.

SUMMARY OF THE INVENTION

It is an object of the invention to provide a speed control device for a sewing machine that has any connection line broken in the connection between a controller and a machine body so that the breaking can be immediately detected to urgently stop the sewing machine. Even when a component part has a dispersion, the variable range of the controller can be corrected so as to be constant.

DETAILED DESCRIPTION OF THE PREFERRED EMBODIMENT

An embodiment of the invention will be described in detail with reference to the accompanied drawings. The instant speed control device is composed of a control circuit arrangement shown in FIG. 1.

1. Controller and breaking detector circuit[1] which generate a variable potential Va proportional to the stepping amount of the controller, and generate a potential Vb at the node between a variable resistor VR and a breaking detecting resistor R.

2. First analog-to-digital converter[2] which converts the analog variable potential Va depending upon the stepping amount of the controller into a digital value.

3. Second analog-to-digital converter[3] which converts an analog potential Vb of the breaking detecting resistor into a digital value.

4. Machine motor drive circuit[9] which changes the rotation speed of the sewing machine by controlling firing phase of AC source.

5. Machine motor[10] which rotates the upper shaft of the sewing machine for reciprocating a needle bar vertically and feeding a fabric.

6. Computer system which is composed of a stored program type where an input port[4], an output port[6], RAM (random access memory)[7] and ROM (read only memory) are connected to CPU (central processing unit[5]) by address buses and data buses.

Figure 1:
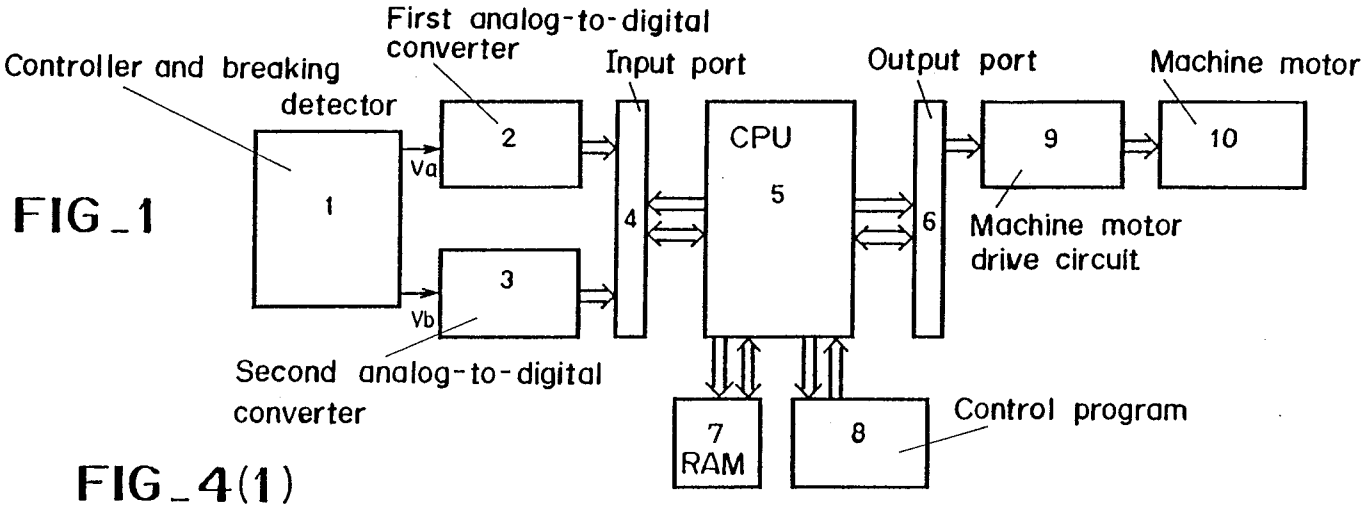
FIG. 1 is a block diagram showing an electrical arrangement of a speed control device according to the invention.
Figure 2:
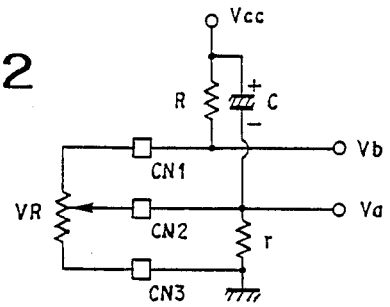
FIG. 2 is a circuit diagram of a controller/breaking detector.

In addition, the control circuit which actually detects the breaking of connectors (the controller/breaking detector circuit in FIG. 1) is composed of components as shown in FIG. 2.

VR: Variable resistor (controller) which is disposed outside of the sewing machine and is connected to the machine body by connectors (CN1, CN2 and CN3) via a code of 1 or 2 meters.

R: Breaking detection resistor which brings the potential Vb to H level when the connector CN1 or CN2 has broken.

r: Pull-down resistor which has high resistance and brings the potential Va to L level when the connector CN2 has broken.

C: Cleaning current capacitor where the node of the connector CN2, or the contactor of the variable resistor VR might undergo a defective contact ascribable to an oxide film, and parts of the oxide film are reduced in that, at closure of the power source, a current several milliamperes is caused to flow through the capacitor.

CN1, CN2, CN3: connectors which connect the controller to the sewing machine.

Va: Variable potential: which is potential of the variable resistor VR which changes depending upon the stepping amount of this variable resistor at the controller.

Vb: Breaking detection potential which is obtained in that a power source voltage Vcc (5 volts) is divided by the sum between the resistance of the breaking detection resistor R and the maximum resistance of the variable resistor VR, and this detection potential Vb is set at a value lower by several hundred millivolts than the power source voltage Vcc of 5 volts, and the design value thereof is denoted by Vk.

Regarding detection of the breaking, the aspects of the breaking and the potentials Va and Vb on those occasions are as follows:

(1)

*The connector CN1 breaks solely.

*The connectors CN1 and CN2 break simultaneously.

*the connector CN1 breaks, and thereafter either or both of the connectors CN2 and CN3 breaks or break.

*The connectors CN1 and CN2 break simultaneously, and thereafter the connector CN3 breaks.

*The connectors CN2 and CN3 break simultaneously, and thereafter the connector CN1 breaks.

*The connectors CN1, CN2 and CN3 break simultaneously.

Figure 3:
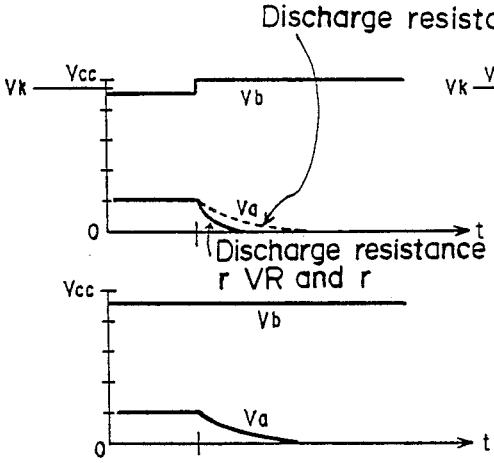
FIG. 3-(1) through FIG. 3-(5) are diagrams showing the electric waveforms of a variable potential Va and a breaking detection potential Vb in breaking.
Figure 3:
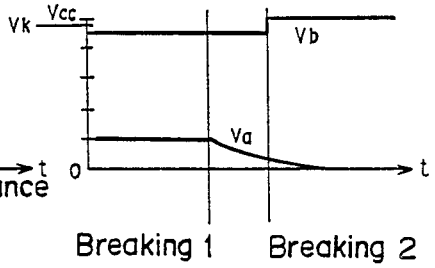
Figure 3:
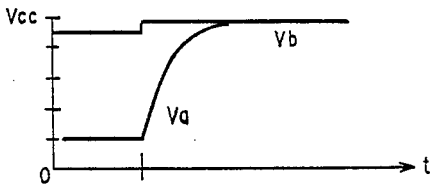
Figure 3:
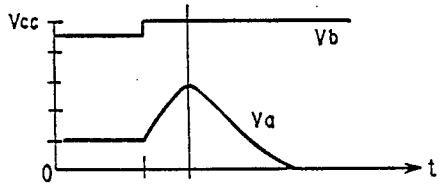
Figure 3:
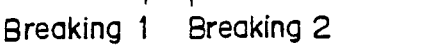

Any of the above mentioned cases—FIG. 3-(1)

The variable potential Va of the controller becomes zero volt after a period of time for which the capacitor C is discharged by the high resistance r or the variable resistance VR.

On the other hand, the breaking detection potential Vb is instantly brought to the potential of the power source Vcc by the breaking detecting resistance R.

(2) The connector CN2 breaks, and thereafter either or both of the ocnnectors CN1 and CN3 breaks or break—FIG. 3-(2)

The variable potential Va becomes zero volt after a period of time for which the capacitor C is discharged by high resistance r The breaking detection potential Vb becomes instantly the potential of the power source Vcc as in the above case (1) when either or both of the connectors CN1 and CN3 has or have broken.

(3) The connector CN2 breaks—FIG. 3-(3).

The variable potential Va becomes zero volt after a period of time for which the capacitor C is discharged by the high resistance r. the breaking detection potential Vb remains unchanged.

(4) The connector CN3 breaks—FIG. 3-(4)

The variable potential Va becomes the potential of the power source Vcc after a period of time for which charges stored in the capacitor C are discharged by the resistance R and the variable resistance VR.

(5) The connector CN3 breaks, and thereafter either or both of the connectors CN1 and CN2 breaks or break—FIG. 3-(5)

The variable potential Va rises toward the power source voltage Vcc for the reason that the charges of the capacitor C are discharged by the variable resistance VR. When any connector other than the connector CN3 has thereafter broken, a discharging circuit does not exist any longer, and the variable potential Va becomes zero volt after a period of time for which the charges of the capacitor C are discharged by the high resistance r.

After all, when the connector CN2 has broken, the variable potential Va changes toward 0 volt just after as the controller has been separated, and rotation of the sewing machine is inevitably stopped.

When the connectorother than the connector CN2 (or the combination of the connector CN2 with the other connector) has broken the breaking detection potential Vb is raised toward the power source voltage Vcc by the breaking, and it becomes greater than the design value Vk. This potential Vb is digitized by the second analog-to-digital converter 3 in FIG. 1, and the digital value is input to CPU. The magnitude of the digital value is compared with the design value Vk in accordance with the control program, whereby the breaking is recognized. Then, CPU inhibits the output of the ignition phase signal from the driver circuit so as to stop the sewing machine.

In the case of the prior art, the breaking is judged with only the variable potential Va of the controller. Therefore, in each of the breaking modes of FIGS. 3-(3) and 3-(4) in which the variable potential Va increases toward the power source potential Vcc immediately after the breaking, the sewing machine rotates at high speed until the potential Va becomes a value with which the breaking is recognized, and the stop of the sewing machine lags long. If the breaking detection based on the potential Vb according to the present invention is adopted, the sewing machine can be stopped immediately after the breaking, so that the safety of the speed control is enhanced.

The present invention is advantageous as to correction of the variable range of the controller.

More specifically, the potential Vb of the breaking detection resistance is utilized for correcting the following drawbacks which might arise depending upon the component accuracies of the variable resistor VR, the breaking detection resistor R and the pull-down resistor r.

Figure 4:
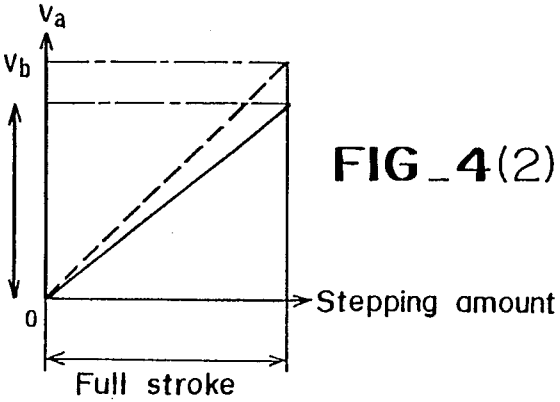
FIG. 4-(1) and FIG. 4-(2) are diagrams showing the relationships between a stepping amount and the variable potential Va, depending upon dispersion of a variable resistor.
Figure 4:
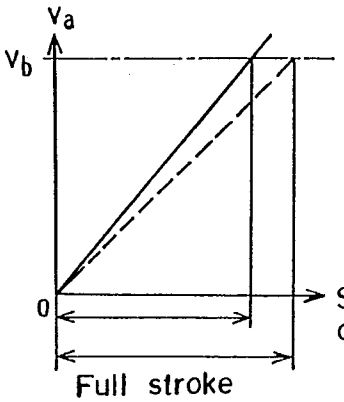

(1) Case (FIG. 4-(1)) where the resistance of the variable resistor VR is high relative to that of the breaking detecting resistor R:

The variable potential Va vs the stepping amount of the controller becomes greater than its design value, and the highest rotation speed of the sewing machine (the highest potential of the variable potential Va) is reached during stepping the controller. That is, the variable range of the controller narrows.

(2) Case (FIG. 4-(2)) where the resistance of the variable resistor VR is low relative to that of the breaking detection resistor R:

The variable potential Va vs the stepping amount of the controller becomes less than its design value, and the variable potential Va cannot be set at the highest potential even when the controller is stepped at the maximum.

In order to eliminate these inconveniences, a correction coefficient k is evaluated using the design value Vk of the potential Vb and the value of the potential Vb actually measured by the second analog-to-digital converter in FIG. 1, and the actual measurement value of the variable potential Va is corrected by the following calculation:

$$Va' = Va \cdot k$$

The correction coefficient k can be obtained as the ratio between the design value Vk and actual measurement value of the breaking detection potential Vb as follows.

| | |
|---|---|
| k = Vk/Vb | k < 1 for the case (1),<br>k > 1 for the case (2). |

Figure 5:
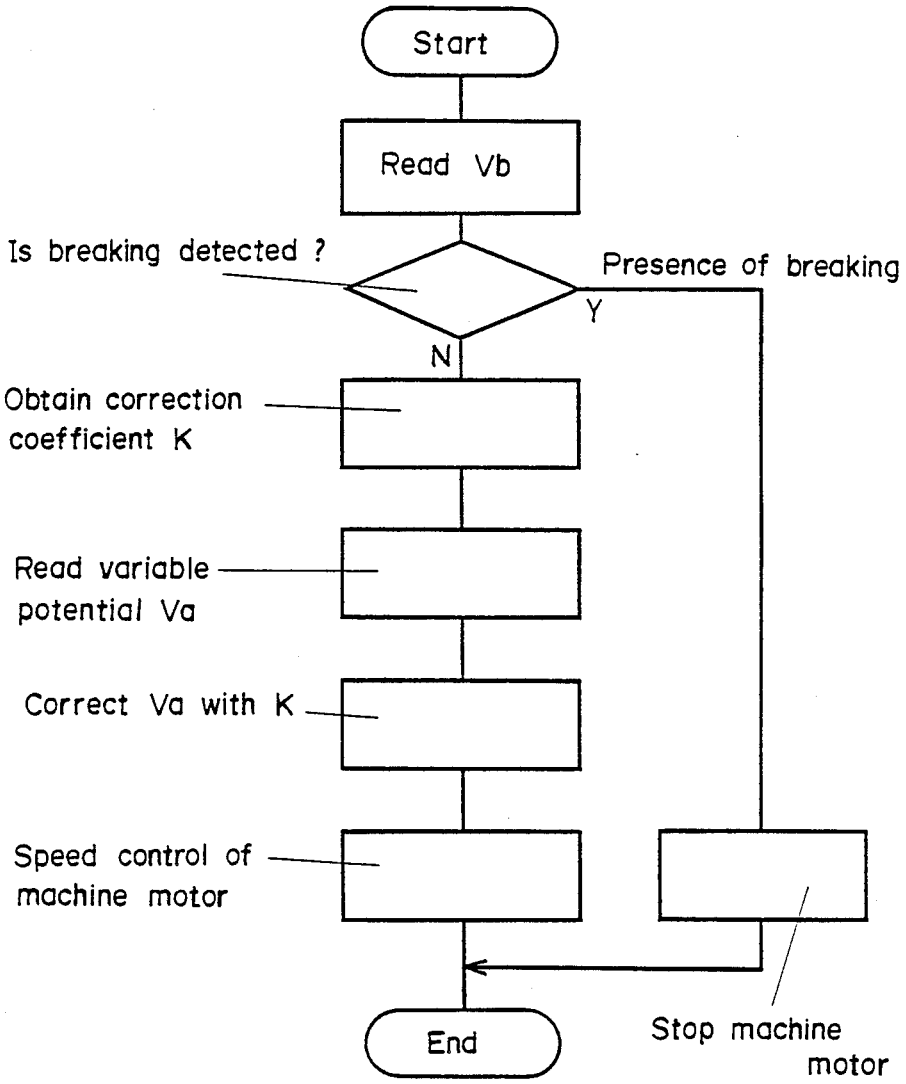
FIG. 5 is a flow chart of a speed control module.

The control program of the speed control device is stored in ROM. FIG. 5 shows the schematic flow chart of a speed control module.

The control program is executed in accordance with the following steps.

1. The breaking detection potential Vb is read from the second analog-to-digital converter.
2. If the breaking detection potential Vb is greater than its design value Vk, the machine motor is stopped.
3. The correction coefficient k is calculated.
4. The variable potential Va of the controller is read from the first analog-to-digital converter.
5. The variable potential Va is corrected with the correction coefficient k.
6. The rotation speed of the sewing machine is controlled with the corrected variable potential Va'.

What is claimed is:

1. A speed control device for a sewing machine, comprising:

a controller/break circuit including a variable resistor for speed control and a break detection resistor for break detection, said variable resistor having a plurality of terminals, both of said resistors being electrically connected to each other, said controller/break circuit also including comparing means for comparing values indicative of a variable potential of said variable resistor and of a break detection potential of said break detection resistor with a predetermined set value of a correspoonding potential so as to thereby detect a break of at least one of any of the terminals and consequently slow a rotation speed of the sewing machine instantly down to zero.

2. A speed control device as defined in claim 1; and further comprising:

a first converter for converting an analog value of the variable potential of the variable resistor into a digital value; and a second converter for converting an analog value of the break detection potential of the break detection resistor into a digital value, said comparing means being formed to compare any one of the digital values with the predetermined set value of the corresponding potential so as to thereby detect the break at at least one of any of the terminals and consequently slow the rotation speed of the sewing machine instantly down to zero.

3. The device as defined in claim 2, wherein said variable resistor is formed as a controller with a variable speed range, said controller/break circuit including correcting means responsive to a narrowing of said variable speed range of said controller and a lowering of a highest rotation speed of the sewing machine due to dispersion in component accuracies of said variable resistor and said break detection resistor so as to correct said variable potential of said variable resistor by multiplying a correction coefficient, which correction coefficient corresponding to a ratio between said digital value as converted by said second converter and a predetermined design value of said breaking detection potential.

4. The device as defined in claim 1, wherein said variable resistor is formed as a controller with a variable speed range, said controller/break circuit including correcting means responsive to a narrowing of said variable speed range of said controller and a lowering of a highest rotation speed of the sewing machine due to dispersion in component accuracies of said variable resistor and said break detection resistor so as to correct said variable potential of said variable resistor.

5. The device as defined in claim 1, wherein said resistors are connected in series and said variable resistor has three terminals.

6. A speed control device for a sewing machine, comprising:

a controller/break detection circuit including a variable resistor for speed control and a break detection resistor, said variable resistor having a plurality of terminals, said circuit including comparing means responsive to said resistors for detecting a break of at least one of any of said terminals, both of said resistors being electrically connected to each other, said circuit including means responsive to said comparing means detecting the break for slowing a rotation speed of the sewing machine instantly to zero even though the break of the terminals causes a variable potential of said variable resistor to increase toward a power source potential immediately after the break.

7. The device as defined in claim 6, wherein said plurality of terminals includes a first, a second and a third terminal, said break detection resistor being formed to bring a break detection potential of said variable resistor to a predetermined level when there is a break with one of said first and second terminals, said controller/break detection circuit including a pull-down resistor formed to bring said break detection potential of said variable resistor to another predetermined level when there is a break with said second terminal.

8. The device as defined in claim 6, wherein a break detection potential at said break detection resistor is formed as a division of a power source voltage by a sum between a resistance of said break detection resistor and a maximum resistance of said variable resistor and is set at a value that is a plurality of hundred of millivolts lower than the power source voltage.

9. A method for controlling speed of a sewing machine that has a motor, comprising the steps of:

ascertaining values indicative of a variable potential of a variable resistor and a break detection potential of a break detection resistor;

detecting a break of at least one of any of a plurality of terminals of said variable resistor by comparing the ascertained values with a predetermined set value of a corresponding potential; and slowing a rotation speed of the sewing machine motor instantly down to zero in response to the detected break.

10. The method as defined in claim 9, wherein the detecting step includes the steps of comparing the break detection potential with a predetermined design break detection potential; and the slowing step further comprising:

stopping the sewing machine motor in response to the comparing step revealing that the break detection potential is greater than the predetermined design break detection potential.

11. The method as defined in claim 10, and further comprising the steps of:

calculating a correction coefficient;

correcting the variable potential with the correction coefficient; and controlling the rotation speed of the sewing machine with the corrected variable potential.

12. The method as defined in claim 9, wherein the ascertaining step includes ascertaining the values in digital form by converting analog values into digital values.

* * * * *